United States Patent [19]

Gravel et al.

[11] 4,246,850

[45] Jan. 27, 1981

[54] INCINERATOR

[75] Inventors: Jean J. O. Gravel, Chambly; William K. Lombard, Weston, both of Canada

[73] Assignee: Trecan Limited, Canada

[21] Appl. No.: 21,122

[22] Filed: Mar. 16, 1979

[51] Int. Cl.[3] ..... F23G 5/12

[52] U.S. Cl. ..... 110/235; 110/203; 110/210; 110/214

[58] Field of Search ..... 110/203–207, 110/210–214, 235, 236

[56] References Cited

U.S. PATENT DOCUMENTS

| | | | |
|---|---|---|---|
| 3,456,603 | 7/1969 | Studler | 110/214 |
| 3,465,696 | 9/1969 | Amundsen | 110/203 X |
| 3,543,700 | 12/1970 | Baigast et al. | 110/213 |
| 3,651,771 | 3/1972 | Eberle | 110/213 |
| 3,664,277 | 5/1972 | Chatterjee et al. | 110/212 |
| 3,670,667 | 6/1972 | Faurholdt | 110/214 X |
| 3,713,402 | 1/1973 | Ahrend | 110/203 X |
| 3,776,153 | 12/1973 | Stewart | 110/203 |
| 3,807,321 | 4/1974 | Stockman | 110/212 X |
| 3,847,093 | 11/1974 | Foster | 110/203 X |
| 3,859,934 | 1/1975 | Weholt | 110/203 |
| 3,896,745 | 7/1975 | Mainka et al. | 110/211 |
| 4,027,602 | 6/1977 | Mott | 110/203 |
| 4,080,909 | 3/1978 | Nalbandian et al. | 110/235 |
| 4,161,916 | 7/1979 | Applegate | 110/203 |

FOREIGN PATENT DOCUMENTS

| | | |
|---|---|---|
| 473344 | 5/1951 | Canada . |
| 512160 | 4/1955 | Canada . |
| 588839 | 12/1959 | Canada . |
| 597086 | 4/1960 | Canada . |
| 688620 | 6/1964 | Canada . |
| 811453 | 4/1969 | Canada . |
| 870361 | 5/1971 | Canada . |
| 886319 | 11/1971 | Canada . |
| 932212 | 8/1973 | Canada . |
| 933416 | 9/1973 | Canada . |
| 946217 | 4/1974 | Canada . |
| 963316 | 2/1975 | Canada . |

*Primary Examiner*—John Petrakes

*Attorney, Agent, or Firm*—Hirons, Rogers & Scott

[57] ABSTRACT

An incinerator for burning garbage has a combustion chamber and an after-burner chamber. The top wall of the combustion chamber has an open loading aperture therein. An air curtain of over-fire combustion air is provided below the loading aperture, to prevent exhaust of gases and suspended solids through the loading aperture, by means of a slot jet extending the length of the combustion chamber and directing a stream of air across the chamber. This air is also used as combustion air, along with under-fire air supplied to the bottom of the chamber and further air supplied to the after-burner chamber. Efficient combustion air flow patterns are established reducing the over-all requirement for combustion air in the incinerator of the invention.

5 Claims, 5 Drawing Figures

FIG.2
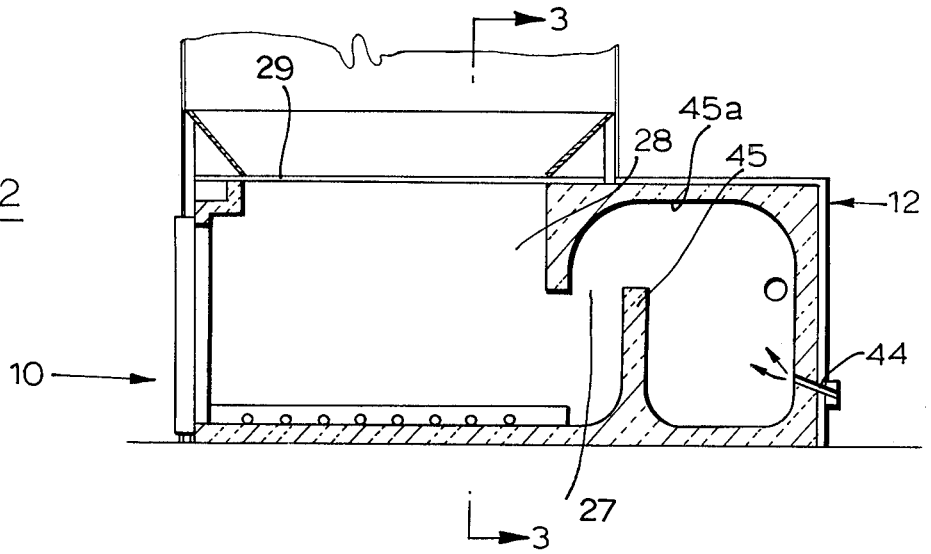
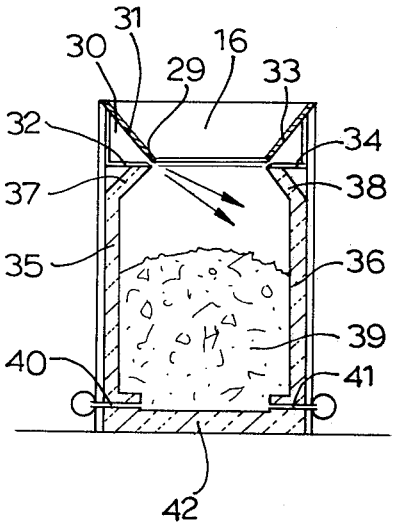
FIG.3
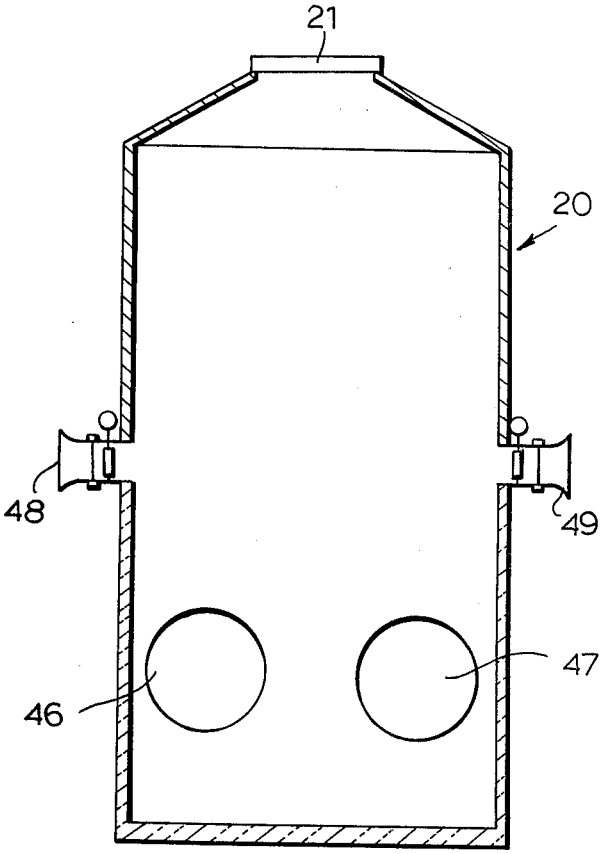
FIG.5

INCINERATOR

FIELD OF THE INVENTION

This invention relates to incinerators and associated apparatus, more specifically to incinerators for burning solid wastes or garbage, discarded from households.

BACKGROUND OF THE INVENTION

Municipal and household garbage or trash is normally delivered to a central location, and the combustible portion is disposed of by combustion in an incinerator. The type of incinerator which is used should be simple to maintain and operate, consume relatively small amounts of fuel, and produce ash or other residual waste products which are clean and readily disposable. In addition, however, it is important that the incinerator and associated apparatus operate in a clean manner, without producing from the garbage being incinerated and releasing into the atmosphere excessive amounts of air borne solid pollutants.

For simple and efficient operation of a solid garbage incinerator, it is desirable that the burning of garbage therein take place continuously over a substantial period of time of several hours, at a relatively rapid rate, with intermittent or continuous addition of further quantities of solid garbage to the already burning garbage in the incinerator. Loading the incinerator in a simple manner, while the garbage therein is burning, without allowing escape of excessive amounts of air borne solid material, presents problems.

SUMMARY OF THE INVENTION

It is an object of the present invention to provide a novel incinerator useful for burning solid garbage, which reduces the aforementioned problems.

The invention provides a trash incinerator which can be loaded at will with trash for incineration, through a convenient top opening directly above the fire, but which is arranged substantially to prevent exhaust gases and solid airborne combustion products from issuing through the top opening. This is achieved by blowing a stream of air from side to side across the combustion chamber below the top opening but above the fire. This creates an air curtain which substantially prevents issue of exhaust gases and solid air-borne particles upwardly through it and hence through the top opening. The air introduced into the chamber in this way serves as a source of over-fire combustion air. The delivery of combustion air in this manner and suitable arrangement of the exhaust outlet from the combustion chamber into an after-burner chamber helps to establish circulating air patterns which lead to efficient combustion and reduced requirements for combustion air. The air curtain reduces the amount of excess air used in the incinerator to approximately 25% excess, as compared with the usual 200% excess used in conventional uncontrolled air access incinerators. Nevertheless, the small amount of excess air provided by the air curtain in the incinerator of the invention allows a much higher burning rate than that obtained in controlled air access incinerators, which use less than a stoichiometric amount of air.

Thus, according to the present invention, there is provided an incinerator for incineration therein of combustible products, said incinerator comprising a combustion chamber and an after-burner chamber;

the combustion chamber having a bottom surface for receiving combustible material, a loading aperture located above the bottom surface through which combustible material may be loaded onto the bottom surface for incineration, and air inlet means located at a vertical level below the aperture, and adapted to blow air at substantial velocity across the upper interior of the combustion chamber below the loading aperture and above the level of combustible material in the chamber, to create an air curtain and control air flows across said aperture;

the after-burner chamber communicating with the combustion chamber, and communicating with a combustion gas exhaust means.

DESCRIPTION OF THE PREFERRED EMBODIMENTS

The air inlet means preferably comprise air inlet nozzles, jets or horizontal slots, arranged along the top part of one side wall of the combustion chamber, directed in a slight downward direction across the width of the combustion chamber, so as to provide an air curtain across the upper loading aperture and to establish satisfactory air circulation patterns within the chamber. Most preferably, the means for blowing in air comprises a continuous slot air jet extending substantially the full width of a side wall of the combustion chamber.

In a preferred embodiment, the combustion chamber is also provided, near its bottom wall, with under-fire air inlet means, through which additional amounts of air, optionally in admixture with a fuel oil, can be admitted to assist in obtaining complete combustion of garbage in the incinerator.

The velocity of the air blown across the upper interior of the chamber should be substantial, and high enough to create an effective air curtain and air circulation within the chamber. To some extent, the velocity of air at the air inlet means necessary to achieve these desirable results depends upon the size and geometry of the combustion chamber, and the amount of garbage and combustion temperature in the combustion chamber. The velocity of this air is preferably from about 4,000 to about 16,000 feet per minute, most preferably from about 8,000 to about 16,000 feet per minute, depending to some extent upon the width of the chamber across which the air is blown. In general, the smaller this width, the lower the air velocity can be to form an effective air curtain.

As noted, the incinerator of the invention includes an after-burner chamber communicating with the combustion chamber at a location below the air curtain. Combustion gases from the combustion chamber exhaust into the after-burner chamber. Preferably, the combustion chamber is generally rectangular as viewed in plan, with the air inlet slot extending continuously along one side wall and the communication between the combustion chamber and the after burner chamber is at one end of the combustion chamber.

The after burner chamber may be supplied with means for supplying air thereto, to mix with the hot exhaust gases from the combustion chamber and to ensure complete combustion thereof.

It is preferred that some of the air needed for complete combustion be added to the exhaust gases in the after burner. This reduces the amount of solid materail carried over into the subsequent exhaust stages of the incinerator system. It also assists in providing control of the amount of air added. The total amount of air which is added, both to the combustion chamber and to the after-burner chamber is such as to maintain the necessary high temperatures for complete combustion. The provision of some of the necessary air to the after-burner chamber allows the amount of air necessary to be adjusted by monitoring the temperature in the after-burner chamber. In the most preferred embodiment according to the invention, the after-burner chamber is designed so that the hot exhaust gases have a cyclonic flow path therein. By these means, better mixing of the exhaust gases with incoming air, to achieve complete combustion, is achieved. Also, suspended solid matter tends to be removed from the gases by such a flow pattern, by centrifugal action, to drop into the after-burner chamber.

The incinerator of the present invention is suitably associated with other components of standard type, for suitably processing and treating the exhaust gases before they are discharged into the environment. A fluid propelling means such as a fan is preferably provided, downstream of the after burner chamber, to assist in drawing the exhaust gases through the incinerator and establish the air and gas flow patterns in the combustion chamber. The incinerator is suitably also associated with a heat exchanger or cooling chamber in which hot gases issuing from the after burner chamber may be cooled, a cleaning means such as a cyclone air cleaner which will extract suspended particles from the exhaust gas streams, and a discharge chimney stack, all of generally standard form. Such items of equipment may be associated with a single combustion and after burner chamber according to the invention, or alternatively and preferably, two or more combustion and after burner chambers according to the invention may be associated with a single common heat exchanger or cooling chamber, gas cleaner, draw fan and chimney stack.

The amount of air or oxygen theoretically require to cause complete combustion of a given amount of garbage can be calculated, and such figures are readily available to those working in this field. It is however normal to supply two and three times the theoretical, stoichiometric amount of air in conventional garbage incineration, to ensure substantially complete incineration of the garbage. However, in the incinerator according to the present invention, such large excesses of combustion air have been found to be unnecessary. The combustion air is supplied, in the preferred embodiment, both to the combusiton chamber as over-fire and under-fire air and to the after burner chamber. Complete incineration of the garbage can be achieved, in many instances, with close to the stoichiometric, or by using only small excess, amounts of air in the incinerator of the present invention, largely due to the air flow patterns and circulations established in the combustion chamber. The amounts are substantially lower than conventionally used in incinerators for this purpose. In addition, the provision of the air supply in a manner to create an air curtain across the top inlet, as well as these air flow patterns, means that a top loading aperture, directly above the fire, can be used, without substantial risk of escape of air-borne particles into the environment therefrom. For ease and simplicity of loading, and rapid incineration, the provision of a loading aperture directly above the fire, so that garbage can be simply tipped or thrown in as incineration proceeds, is much to be preferred. The incinerator according to the present invention allows this feature to be used, without top cover, gates, grilles or the like, whilst at the same time preserving simplicity of structural features and substantial absence of moving parts.

Further, the incinerator according to the preferred form of the present invention does not involve any mechanical agitation of the garbage during combustion. Grates or the like, which case the solid burning garbage to fall during incineration, are not necessary. The air and gases flow around and through the burning garbage, but no substantial disturbance of it is caused. Consequently the amount of ash and the like which is carried over in the exhaust gas stream, into and through the after burner chamber, is low. This means that the gas purifying equipment employed downstream of the after burner chamber can be of a lower cost, simpler type, e.g. of the cyclone type instead of an electrostatic precipitator, to reduce emissions to acceptable levels.

BRIEF REFERENCE TO THE DRAWINGS

FIG. 2 is a cross sectional side elevation of the combustion and after burner chambers of the incinerator assembly of FIG. 1, taken along the line 2—2 of FIG. 1;

FIG. 3 is a cross sectional view of the combustion chamber along the line 3—3 of FIG. 2;

FIG. 5 is a vertical cross sectional view of the quench tower of the incinerator assembly of FIGS. 1-4, along the line 5—5 of FIG. 4.

In the drawings, like reference numerals indicate like parts.

DETAILED DESCRIPTION OF THE SPECIFIC PREFERRED EMBODIMENT

Figure 1:
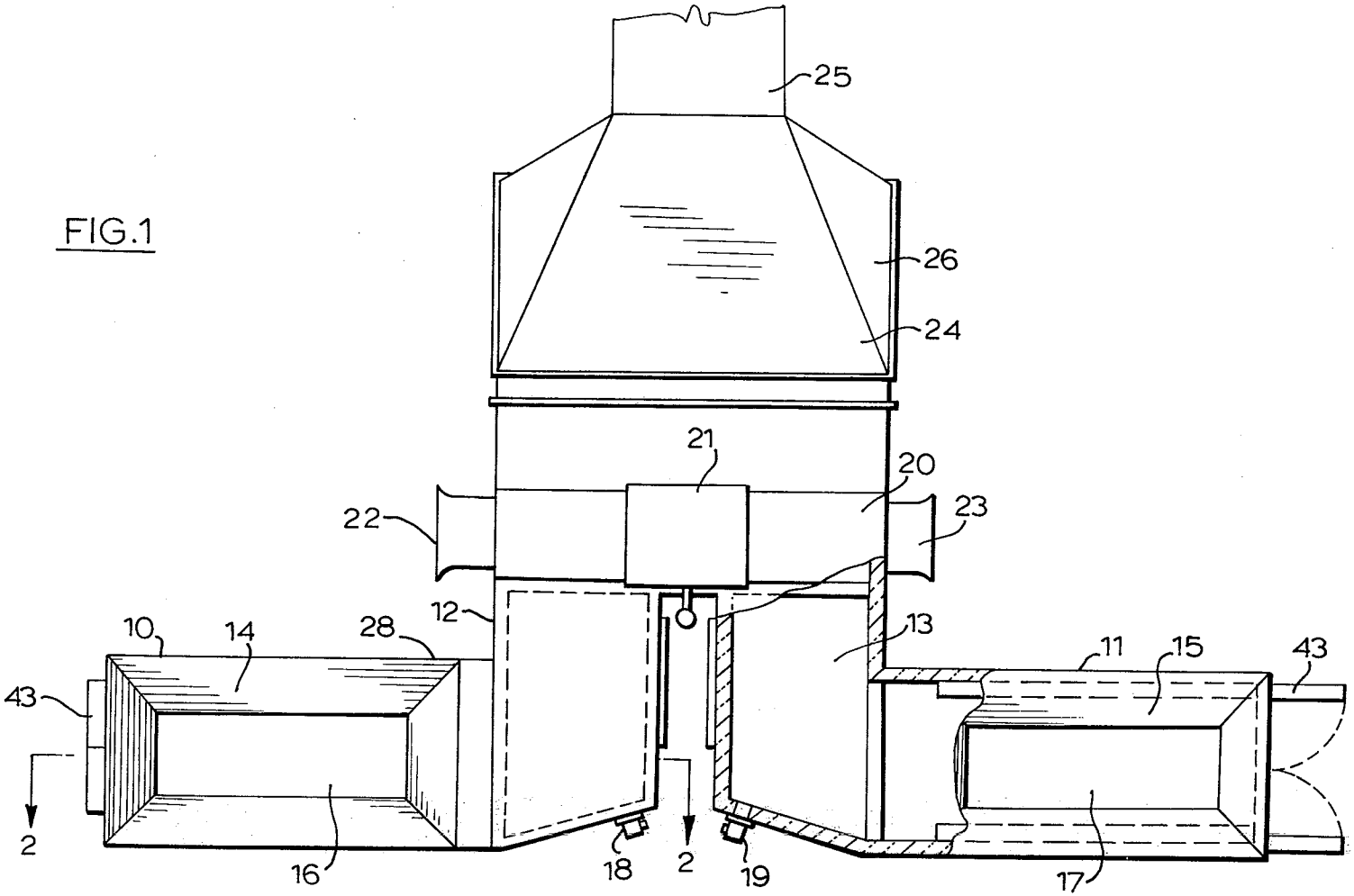
FIG. 1 is a top plan view, partly cut away and somewhat diagrammatic, of an incinerator assembly according to the present invention.

With reference to FIG. 1, the incinerator assembly according to the invention includes two combustion chambers 10, 11, each communicating with an associated after-burner chamber 12, 13. The combustion chambers 10 and 11 are rectangular as viewed in plan and the respective upper walls 14, 15 thereof are provided with top rectangular apertures 16, 17 respectively, through which garbage for combustion can be dropped into the combustion chambers. The after-burner chambers 12, 13 are provided with respective fuel oil burners 18, 19 in side walls thereof, which can be operated to assist in complete combustion of any combustible material carried over from the combustion chambers 10, 11.

The after-burner chambers 12, 13 are both in communication with the lower end of a single generally vertically disposed quenching tower 20. Exhaust gases from the combustion chambers 10, 11 thus pass through the after-burner chambers 12, 13 and then upwardly through quench tower 20. A removable top cover plate 21 is provided at the top of the quench tower 20. The quench tower is also provided with a pair of air inlets 22, 23 through which cooling air can be drawn in from outside as gases flow upwardly through the tower 20. The upper part of the tower 20 communicates by suitable ducting 24, 25 to other associated parts of standard form, omitted from FIG. 1. A gas cleaner 26 of the cyclone type is provided below ducting 24 and communicating therewith, to remove suspended air borne particles from the gases flowing through ducting 24.

With reference to FIGS. 2 and 3, the combustion chamber 10 and after-burner chamber 12 are in communication at 27 at a level below that of the air curtain. The combustion chamber 10 is generally rectangular as viewed in plan, and the communication 27 with the after-burner chamber is at one end 28 of the combustion chamber.

As shown in FIG. 3 the combustion chamber 10 is provided with an over-fire air inlet means 29, in the form of a horizontally disposed slot jet extending along the length of one side wall of the chamber 10. The slot jet 29 is formed as the outlet from a triangular cross-section air chamber 30 extending the length of the chamber 10, and defined between a downwardly inclined upper plate 31 and a horizontal projection 32 extending from the side wall inwardly of the chamber 10. A corresponding downwardly inclined upper plate 33 and horizontal projection 34 are provided on the opposed side wall of the chamber 10. The downwardly inclined plates 31, 33 comprise the upper wall 14 of the chamber 10 and provide a loading chute for garbage entering the chamber 10 for incineration. The lower, inner edges of the plates 31, 33 define the aperture 16 in the upper wall of the chamber 10. Air supplied through slot jet 29 thus provides over-fire combustion air, and forms an air curtain below aperture 16.

The chamber 10 is lined along its side walls with linings of a refractory material 35, 36. The upper ends of linings 35, 36 are inwardly inclined formations 37, 38 respectively. These formations assist in the establishment of circular flow patterns around the chamber 10, of air from the jets 29, this circulation being generally clockwise, as viewed in FIG. 3, through the burning trash 39 therein. As shown in FIG. 3, the jet 29 is arranged to blow primary combustion air into the chamber 10 across the width of the chamber 10 below the level of upper aperture 16 and above the level of the burning trash 39, at a slight downward angle.

The combustion chamber 10 is also provided with a pair of sets of air/oil inlets 40, 41, one set extending along the bottom of each side wall of the chamber 10. The inlets 40, 41 can be used to feed into the chamber 10 under-fire combustion air during the burning of garbage 39 in the chamber 10. Supplying air through these inlets can assist in establishing the desirable flow patterns in the chamber 10, and serve to burn off carbon deposits forming in the lower portion of the chamber 10. These same inlets 40, 41 can also be used if desired, to supply fuel into the chamber 10, to assist in the incinerator operation e.g. when starting up the incinerator or when a difficultly combustible garbage item is present in the chamber 10. The sets of inlets 40, 41 extend the length of the side walls of the chamber 10, being defined between the bottom of the side wall refractory linings 35, 36 and a refractory bottom wall 42 of the chamber 10.

The end of chamber 10 remote from its communication with after-burner chamber 12 is provided with doors 43 openable to remove ash periodically as desired, from the bottom of combustion chamber 10.

The after-burner chamber 12, as shown in FIG. 2, has a series of air inlet jets 44 near the bottom thereof, through which further combustion air is supplied to mix with the hot gases issuing from chamber 10 into after-burner chamber 12, and to assist, in conjunction with burner 18, in completing combustion of any combustible products carried over into after-burner chamber 12. The jets 44 are provided along the length of the side wall of the after-burner chamber. The front wall of after-burner chamber 12 is comprised of a baffle 45 of refractory material, extending upwardly from the bottom wall of chamber 12, around which the hot exhaust gases pass in entering after-burner chamber 12. The top wall **45*a* of after-burner chamber 12 has rounded corners and is generally in the shape of an arch. This promotes cyclonic flow of the exhaust gases in chamber 12, to assist in mixing with air from inlet 44** and to assist in centrifuging out particulate matter from the exhaust gas stream.

The hot exhaust gases issue from the after-burner chambers 12, 13 via respective apertures 46, 47 into the quench tower 20, in which the gases move upwardly. The quench tower 20 is provided, at each side, with air inlets 48, 49 (FIG. 5). Air is drawn in through inlets 48, 49 by the combustion gases moving upwardly through tower 20, to mingle with these gases and assist in their cooling and treatment. The cooling tower 20 is also provided with water jets 50, 51 (FIG. 4), through which water is introduced to quench the hot gases flowing up the tower 20. The amount of water supplied is sufficient to cause quenching by evaporation of the water, but insufficient to cause substantial condensation of the water in the tower 20. A clean-out door 52 is provided at the foot of tower 20.

The hot gases exit from near the top of the quench tower 20 via a duct 24. A cyclone type gas cleaner 26 of known type, is connected to the underside of duct 24, to assist in removing suspended solids from gases passing through duct 24. From duct 24, the gases are drawn downwardly through downwardly inclined duct 25 by induction draw fan 53, and vent via duct 54 to chimney stack 55, from the upper end of which the gases are discharged.

Figure 4:
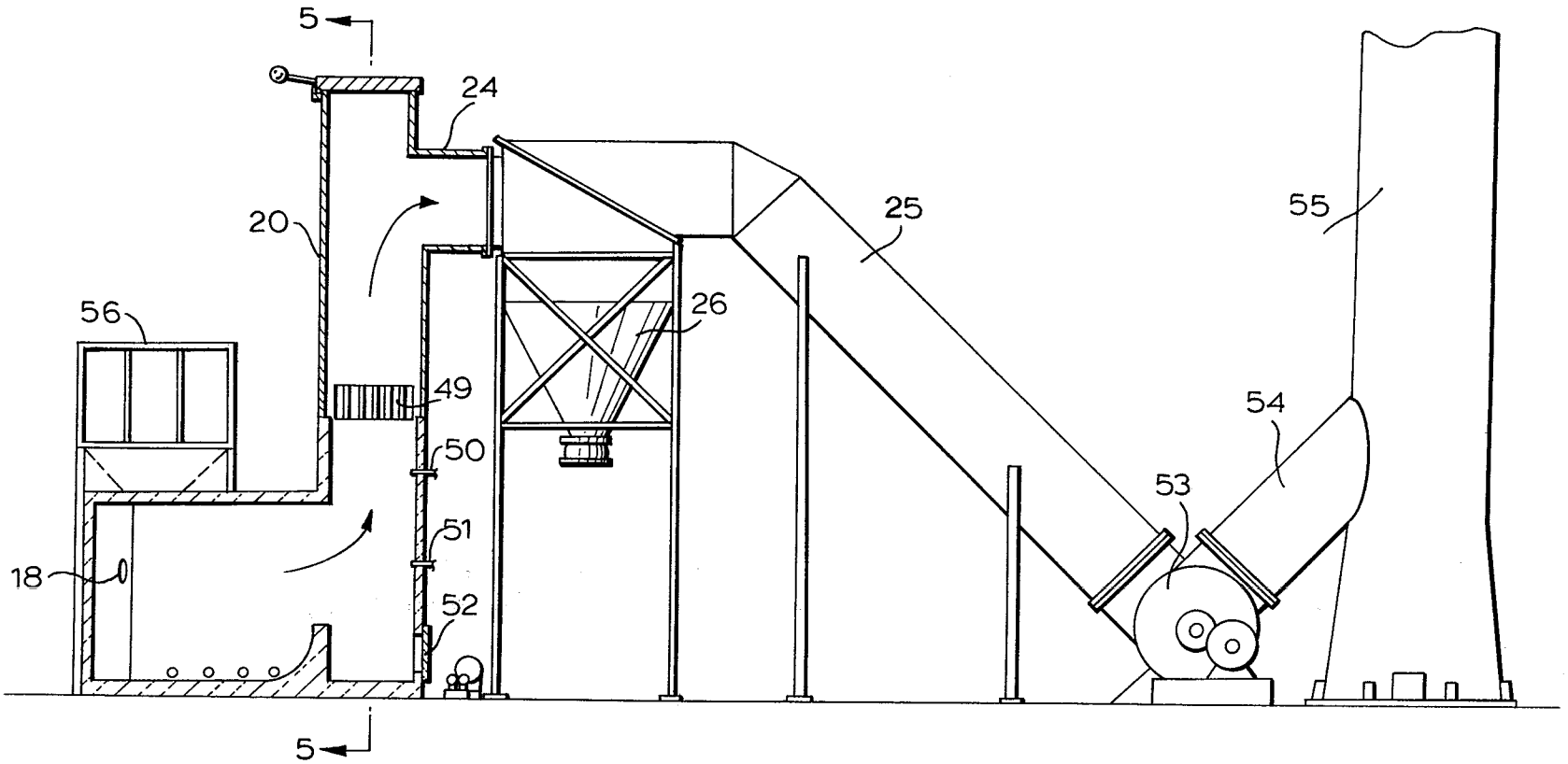
FIG. 4 is a diagrammatic side view, partly in section of the incinerator assembly of FIG. 1.

As shown in FIG. 4, the combustion chamber 10 is provided, above its upper aperture 16, with a screen arrangement 56, to assist in loading the trash to be burned into the chamber, and to prevent dispersal of the trash by wind, during loading of the combustion chamber.

The incinerator of the invention is simple in construction and operation, being substantially free from moving parts and structural complexities in the combustion zone. It provides efficient incineration of normal items of trash of the type collected by municipal authorities, with simple and economical operation and loading.

It will be appreciated that changes in structural items and operational details can be made in the incinerator according to the invention, without departure from the scope of the present invention, which is limited only by the scope of the appended claims.

We claim:

1. A top-loading incinerator for incineration therein of combustible products, said incinerator comprising a combustion chamber and an after burner chamber;

the combustion chamber having a bottom surface for receiving combustible material, a loading aperture located above the bottom surface and in the top wall thereof, through which combustible material may be dropped onto the bottom surface for incineration, and air inlet means located at a vertical level below the aperture said air inlet means extending along substantially the full length of a side wall of said combustion chamber and directed in a downwardly inclined direction, and being thereby adapted to blow combustion air at substantial velocity across the upper interior of the combustion chamber below the loading aperture and above the level of combustible material in the chamber, in an air curtain extending substantially fully and continously across the full width of the chamber between the fire and the loading aperture, and directed at an oblique angle to the side walls of the combustion chamber to promote air circulation therein;

the after burner chamber communicating with the combustion chamber, below the level of the air curtain and communicating with a combustion gas exhaust means.

2. The incinerator of claim 1, wherein the air inlet means comprises air inlet jets or slots arranged along the top part of one side wall of the combustion chamber, to create said air curtain.

3. The incinerator of claim 1, wherein the means for blowing in air comprises a continuous slot air jet extending substantially the full width of a side wall of the combustion chamber.

4. The incinerator of claim 3, wherein the combustion air from said continuous slot air jet is blown in at a velocity of from about 4000 to about 16,000 feet per minute.

5. The incinerator of claim 1 wherein the after burner chamber comprises means for introduction of further quantities of combustion air.

* * * * *